US010239590B2

(12) United States Patent
Montgomery

(10) Patent No.: US 10,239,590 B2
(45) Date of Patent: Mar. 26, 2019

(54) SUCTION STABILIZED FLOATS

(76) Inventor: James Montgomery, Scottsdale, AZ (US)

( * ) Notice: Subject to any disclaimer, the term of this patent is extended or adjusted under 35 U.S.C. 154(b) by 1547 days.

(21) Appl. No.: 13/242,489

(22) Filed: Sep. 23, 2011

(65) Prior Publication Data

US 2012/0090525 A1 Apr. 19, 2012

Related U.S. Application Data

(60) Provisional application No. 61/392,755, filed on Oct. 13, 2010.

(51) Int. Cl.

| | |
|---|---|
| ***B63B 35/44*** | (2006.01) |
| ***B63B 35/73*** | (2006.01) |
| ***B63B 22/00*** | (2006.01) |
| ***B63B 22/20*** | (2006.01) |
| ***B63B 35/34*** | (2006.01) |
| ***E02B 3/06*** | (2006.01) |
| ***A45B 23/00*** | (2006.01) |
| ***A47B 37/04*** | (2006.01) |

(52) U.S. Cl.

CPC ..... *B63B 35/73* (2013.01); *A45B 23/00* (2013.01); *A47B 37/04* (2013.01); *B63B 22/00* (2013.01); *B63B 22/20* (2013.01); *B63B 35/34* (2013.01); *E02B 3/064* (2013.01)

(58) Field of Classification Search

CPC ..... B63B 22/00; B63B 22/18; B63B 22/20; B63B 22/22; B63B 22/24; B63B 35/00; B63B 35/34; E02B 3/064

USPC ..... 441/1, 21, 28, 32; 114/258–267

See application file for complete search history.

(56) References Cited

U.S. PATENT DOCUMENTS

| | | | | |
|---|---|---|---|---|
| 1,840,324 | A * | 1/1932 | Lindquist | 114/264 |
| 1,908,714 | A | 5/1933 | Schneider | |
| 3,097,622 | A | 7/1963 | Bell | |
| 3,301,209 | A * | 1/1967 | Caldwell, Jr. | 114/331 |
| 3,376,588 | A * | 4/1968 | Berteaux et al. | 441/29 |
| 3,870,006 | A | 3/1975 | Hashimoto | |
| 3,896,578 | A | 7/1975 | Franceschini | |
| 4,231,313 | A * | 11/1980 | Heerema et al. | 114/265 |
| 4,241,685 | A | 12/1980 | Mougin | |
| RE32,560 | E | 12/1987 | Givens | |

(Continued)

FOREIGN PATENT DOCUMENTS

| | | |
|---|---|---|
| EP | 0 015 352 | 9/1980 |
| EP | 1 320 486 B1 | 6/2003 |

(Continued)

OTHER PUBLICATIONS

Dumez Gtm, "Floating crude oil store for use at sea," Espacenet, Publication Date: Jul. 9, 1999; English Abstract of FR-2 773 352.

*Primary Examiner* — Daniel V Venne

(74) *Attorney, Agent, or Firm* — Millen, White, Zelano & Branigan, PC

(57) ABSTRACT

Floats having a buoyant portion and a chamber portion hold liquid within their chambers above the interface of the surrounding body of liquid and gas which creates a downward force which stabilizes the float. If the liquid is water, the float holds water in the inner chamber which is disposed above the waterline of the body of water in which the float is suspended. The elevated water exerts a downward force that acts against rocking, swaying, and other destabilizing forces.

5 Claims, 6 Drawing Sheets

(56) References Cited

U.S. PATENT DOCUMENTS

| | | | | |
|---|---|---|---|---|
| 4,898,288 | A * | 2/1990 | Erdbrink | 212/308 |
| 4,927,041 | A | 5/1990 | Hepburn | |
| 5,207,757 | A | 5/1993 | Franceschini | |
| 5,215,025 | A | 6/1993 | Talmor | |
| 5,375,550 | A * | 12/1994 | Innis | 114/267 |
| 5,518,431 | A * | 5/1996 | Staley | B63B 35/76 114/345 |
| 5,775,248 | A | 7/1998 | Simola | |
| 7,780,139 | B2 * | 8/2010 | Markert | E04H 12/2261 135/15.1 |
| 2005/0009422 | A1 | 1/2005 | Warriner | |
| 2006/0225634 | A1 * | 10/2006 | Cho et al. | 114/264 |
| 2008/0003901 | A1 | 1/2008 | Viets | |

FOREIGN PATENT DOCUMENTS

| | | |
|---|---|---|
| FR | 2 773 352 | 7/1999 |
| WO | WO 02/26557 A1 | 4/2002 |

* cited by examiner

SUCTION STABILIZED FLOATS

This application claims the benefit of the filing date of U.S. Provisional Application Ser. No. 61/392,755 filed Oct. 13, 2010, which is incorporated by reference herein.

FIELD OF THE INVENTION

The present invention relates to floats, more particularly suction stabilized floats.

BACKGROUND OF THE INVENTION

Floats have been used through out history to support objects on water and to transport objects over water. Floats are usually made of buoyant materials less dense that the liquid that they are in; for example wood or foam which floats on water, but may be formed of gas (air) enclosing structures or water displacement. Stability of floats on the water has been a problem throughout history that people have attempted to solve. Ballast is used with many floats to achieve improved stability but has the disadvantage of adding weight to the float, especially when the float is removed from the liquid. Another disadvantage of ballast is that ballast needs to be suspended below the center of buoyancy of the float in the liquid and can interfere with activity below the float. Accordingly there is a need for a float that has improved stabilization without using ballast, or where used with ballast, the ballast can be reduced in size or serve an additional or alternative function.

SUMMARY OF THE INVENTION

One embodiment of the invention is directed to floats capable of supporting objects of a predetermined weight not exceeding 150 lbs at an interface between a liquid and a gas with at least one floatation device unitary with or secured to a chamber, wherein the chamber has a first portion that is fluid tight to both gas and liquid and a second portion that is open into the liquid. The first and second portions are unitary or integral and the chamber is floated on the liquid after being at least partially filled with a volume of the liquid raised above the interface.

Other embodiments of the invention are directed to a float with at least one floatation device unitary with or secured to a chamber, wherein the chamber has a first portion that is fluid tight and a second portion adapted to be open into the liquid. The first and second portions are unitary or integral and the chamber is floated on the liquid after being at least partially filled with a volume of the liquid raised above the interface. A gas valve capable of expelling gas from the chamber is also provided.

In one aspect of the invention the liquid is water, the gas is air, and the interface is the water line.

In another aspect of the invention the volume of liquid raised above the interface has a weight at least 25% of the total weight of the float.

In another aspect of the invention a supported object is integrated or attached to the float.

In another aspect of the invention the supported object is an umbrella.

In another aspect of the invention the float is a buoy.

In another aspect of the invention the portion of the float above the interface is flat.

In another aspect of the invention a pump capable of removing gas or aiding in the removal of gas from said chamber is integrated, permanently attached, or temporarily attached to the float.

In another aspect of the invention the supported object is an electronic device or sensor.

In another aspect of the invention the supported object is an antenna or an antenna array.

In another aspect of the invention the float is a dock.

In another aspect of the invention the dock has a connection for connecting to other docks.

In another aspect of the invention the dock is linked together with other floating docks to from a larger structure.

In another aspect of the invention the float is a pontoon.

In another aspect of the invention the float is a table with indentions for cups.

DETAILED DESCRIPTION OF THE DRAWINGS

Figure 1:
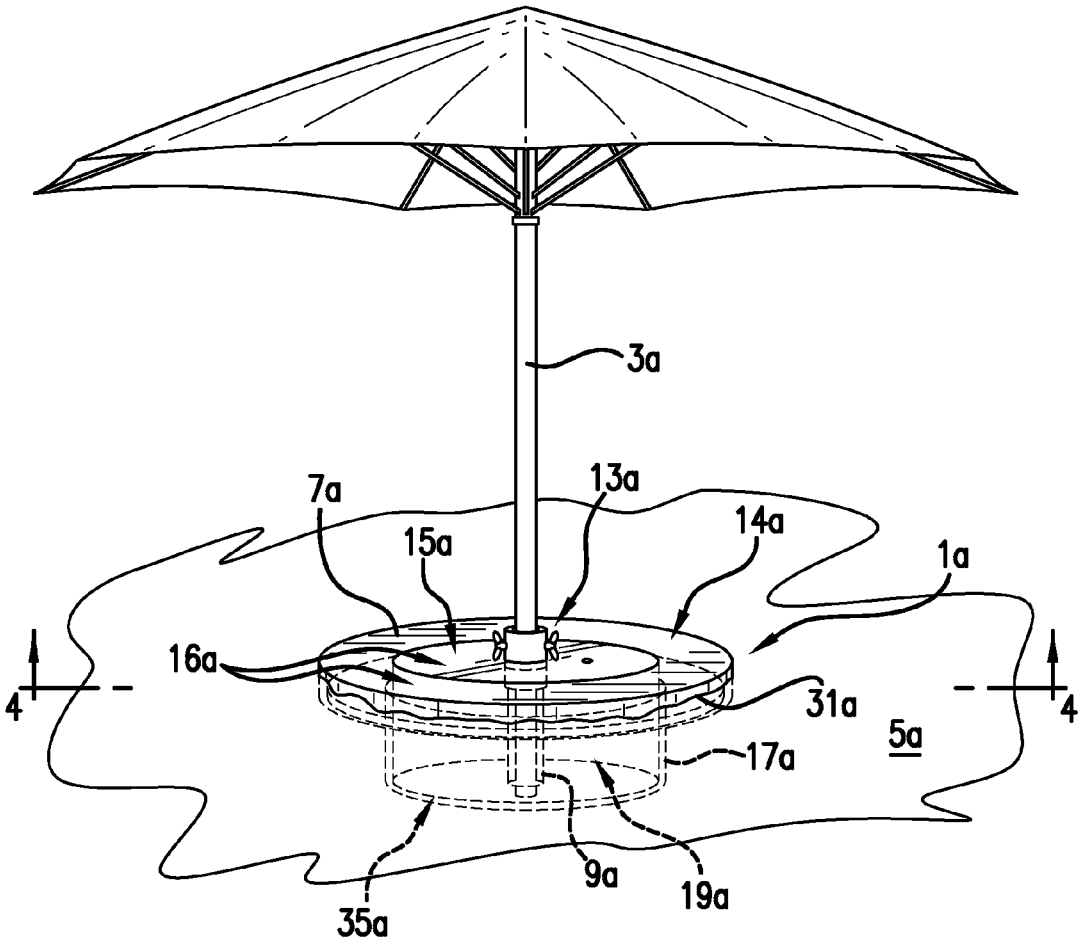
FIG. 1 is a perspective view of the suction stabilized float supporting an umbrella on water.

FIG. 1 is a suction stabilized float 1*a* supporting an umbrella 3*a*, while the float is floating on water 5*a*. The float is made of buoyant material 7*a*, for example foam, wood or the like, which buoyant material is sufficient to keep the float 1*a* and the umbrella 3*a* on or above the interface 31*a* provided by the waterline. The buoyant material 7*a* may optionally make up all or a portion of the structure of the float 1*a*. The umbrella 3*a* is attached via a tube 9*a* that penetrates the chamber surface 15*a* at a location 13*a* least as far as an interface 17*a* shown in FIGS. 2, and 4. The location 13*a* has thumb screws that tighten to hold the umbrella 3*a* in place at a particular height, or loosen for adjustment of the umbrella height. In other embodiments the umbrella 3*a* may be replaced by a different structure or object. The chamber surface 15*a* and the buoyant material surface 14*a* form the float's surface 16*a*. The chamber surface 15*a* is optionally level with the buoyant material surface 14*a*, and is shown as such in FIGS. 1-4. In other embodiments, the chamber surface 15*a* may be either above or below the buoyant material surface 14*a*. The inner chamber 19*a* is fluid tight in all embodiments and has an opening 35*a* opposite or below the chamber surface 15*a*.

Figure 2:
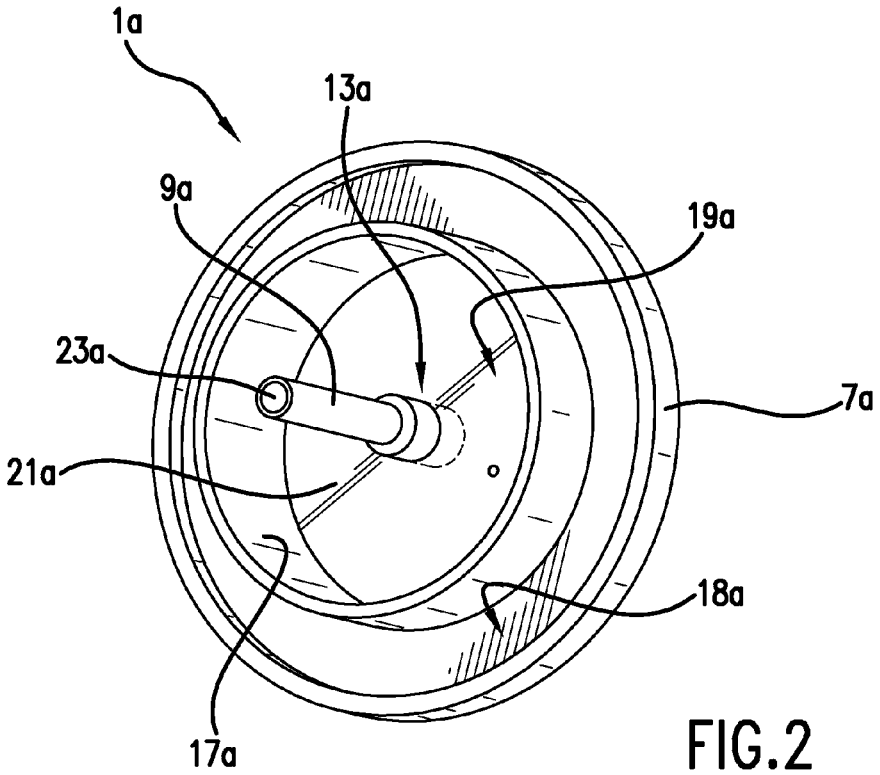
FIG. 2 is a perspective view showing the underside of the suction stabilized float.
Figure 4:
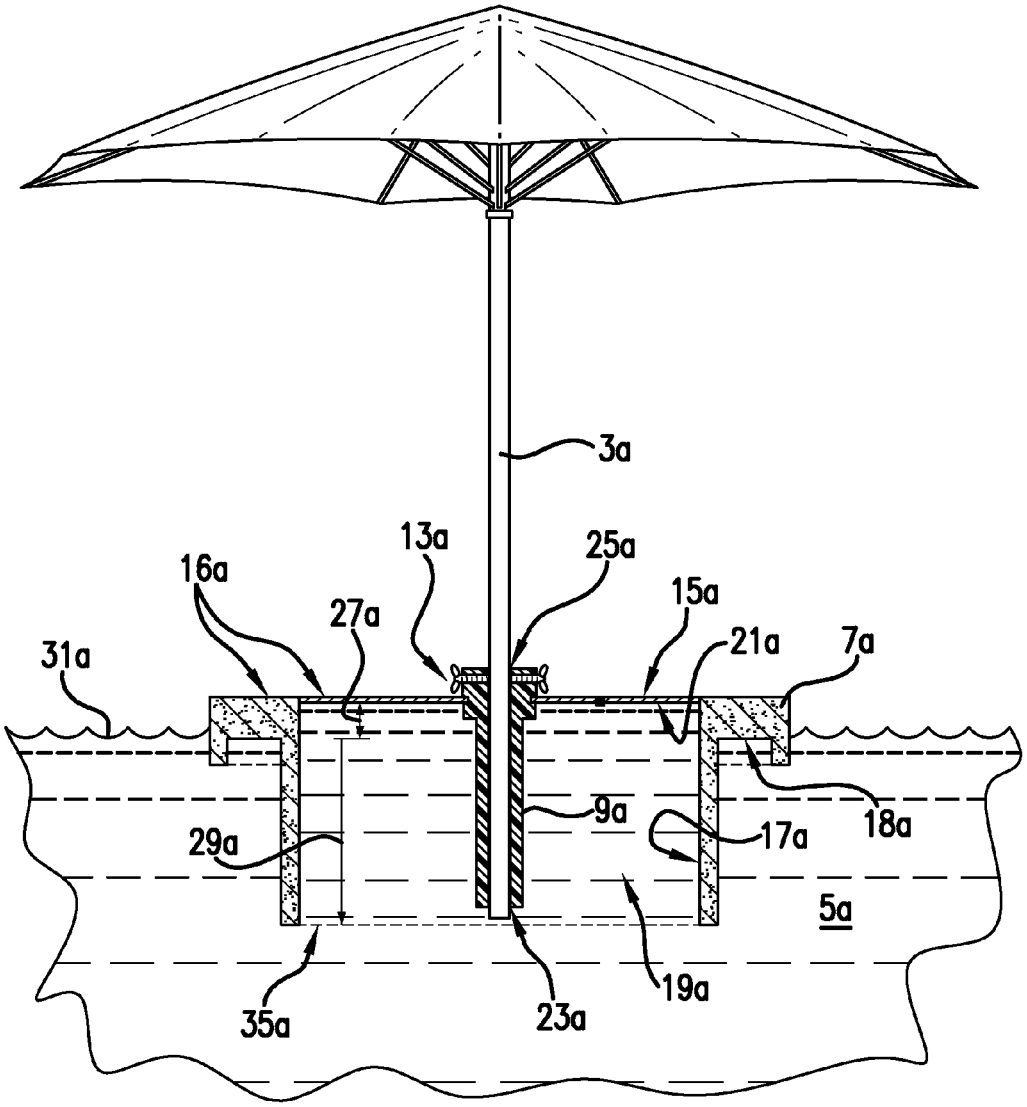
FIG. 4 is an elevational view of the suction stabilized float in water, the view taken along lines 4-4 of FIG. 1.

FIG. 2 shows the underside of a suction stabilized float 1*a*. In the illustrated embodiment, the underside of the float 1*a* comprised of the buoyant material 7*a* has a groove 18*a* but the underside may have other shapes. The boundaries of the inner chamber 19*a* are defined by the inner wall 17*a* and chamber top 21*a* which defines the bottom of chamber surface 15*a* which is shown in FIGS. 1 and 4. The tube 9*a* that holds umbrella 3*a* penetrates the chamber top 21*a* at location 13*a*. Tube 9*a* needs to extend at least the length as the inner wall 17*a* to ensure maximum function of the inner chamber 19*a*, but the inner chamber will still function if the tube 9*a* does not extend as far as inner wall 17*a*. The tube 9*a* has opening 23*a* which allows the umbrella 3*a* to extend down past the end of the tube 9*a* which results in increased height adjustment options.

Figure 3:
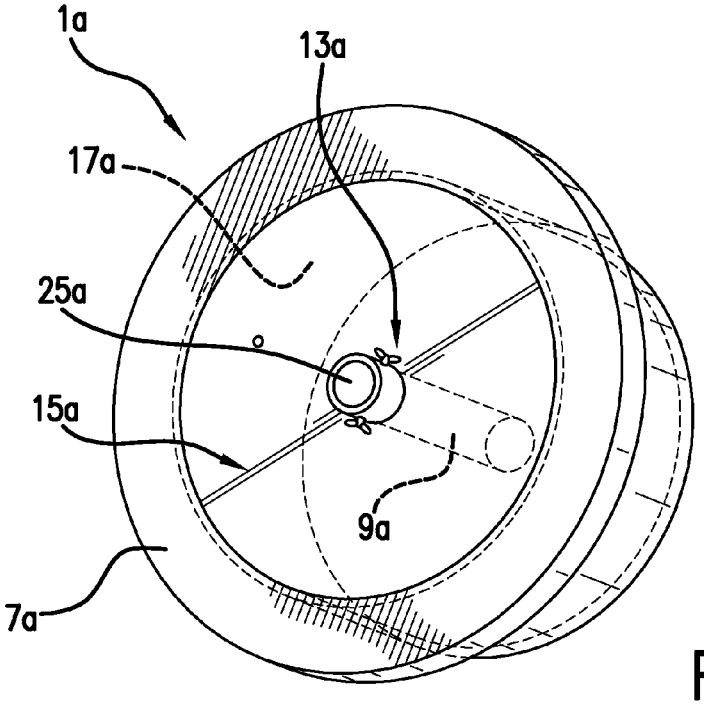
FIG. 3 is a top perspective view of the suction stabilized float.

FIG. 3 shows a view of the float 1*a* from above. The buoyant material 7*a* is shown level with the chamber surface 15*a*, but this alignment is optional. The tube 9*a* penetrates the chamber top 15*a* at location 13*a* with the opening 25*a* of the tube 9*a* allowing the umbrella 3*a* to be attached to the float 1*a*.

FIG. 4 is an elevational view of the float 1*a* floating on water 5*a*. The buoyant material 7*a* is shown level with the chamber top 21*a*, with the inner wall 17*a* and the chamber top 21*a* forming the boundaries of the inner chamber 19*a*. The tube 9*a* penetrates the chamber at location 13*a* and extends below the inner wall 17*a*. The tube 9*a* has opening 23*a* and 25*a* though which the shaft of the umbrella 3*a* passes before being secured in the tube by thumb screws. When the float 1*a* is in use on the water 5*a* an upper portion 27*a* of the inner chamber 19*a* is above the air/water interface 31*a* and a lower portion 29*a* of the inner chamber 19*a* is below the air/water interface 31*a*. The water 5*a* in the upper portion 27*a* above the air/water interface 31*a* exerts a downward force to stabilize the float 1*a*. Optionally, a gas valve is used in the float 1*a* shown in FIGS. 1-4 to remove air from the inner chamber 19*a*.

Figure 5:
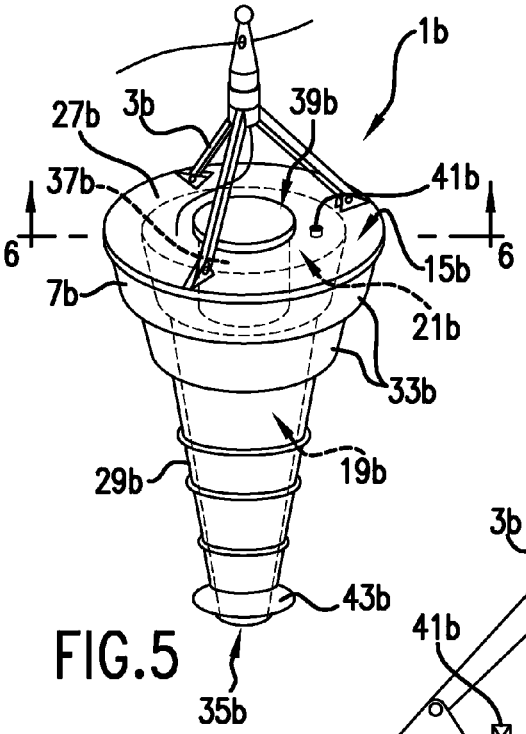
FIG. 5 is a perspective view of a suction stabilized buoy.

FIG. 5 is a perspective view of another embodiment of the invention configured as a suction stabilized buoy 1*b*. The exterior of the buoy 1*b* has a frustoconical outer surface 33*b* and a top surface 15*b*. The inner chamber 19*b* has an opening 35*b* at the bottom and a fluid tight chamber top 21*b*. In FIG. 5 a fluid tight compartment 37*b* that begins at surface 15*b* and extends into the inner chamber 19*b* is accessible though the door 39*b* on the top surface 15*b*. The compartment 37*b* is optionally in other embodiments of the invention. In various embodiments of the invention using a buoy 1*b*, the buoy 1*b* supports a structure 3*b* for supporting objects. The structure 3*b* is optional for other embodiments and may be attached, unattached to, or intergraded into the buoy 1*b*. The objects 3*b* could optionally include for example, an antenna or antenna array, electronic equipment, or other device performing a variety of functions, for example, taking measurements or collecting data, light, providing a signal, or beacon for ships or submarines, or can be a mechanical device for performing some other function. The buoy 1*b* has a gas valve 41*b* to remove gas from inner chamber 19*b* allowing the inner chamber 19*b* to fill with water 5*b*. The upper portion 27*b* remains above the air/water interface.

As is seen in FIG. 5 attached in proximity to the open lower end of the frustoconical portion 29*b* of the buoy 1*b* are ballasts weights 43*b*. In other configurations of the invention, the ballasts weights 43*b* are optional. In the embodiments of the invention using a buoy 1*b* that has ballast 43*b*, the ballast 43*b* functions to self right the buoy in the event that buoy capsizes. In the embodiments where the buoy has a gas valve 41*b*, the gas valve 41*b* functions to reestablish the desired head height if the seal on the gas/liquid inner chamber 19*b* is lost for any reason, for example if the buoy capsizes. In this event, the ballast 43*b* and gas valve 41*b* optionally work to first self right the float 1*b* and then to remove the gas from the inner chamber 19*b*, thus reestablishing suction stabilization.

Figure 6:
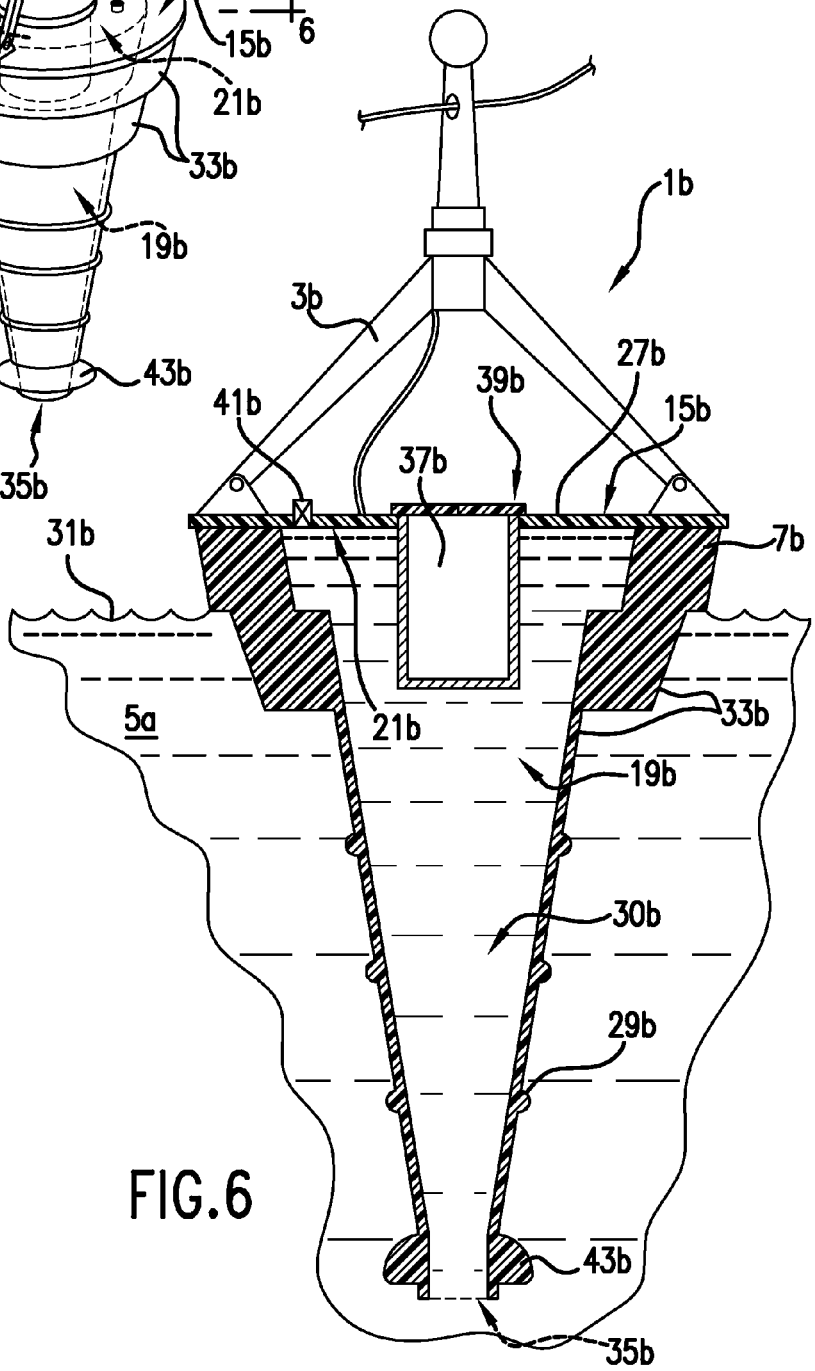
FIG. 6 is an elevational view of the suction stabilized buoy of FIG. 5 taken along lines 6-6 of FIG. 5.

FIG. 6 is an elevational view of the buoy 1*b* floating on water 5*a*. The buoyant material 7*b* is sufficient to float the entire buoy 1*b* and any object(s) 3*b* supported by the buoy. The inner chamber 19*b* has an opening 35*b* at the bottom and a fluid tight chamber top 21*b*. The upper portion 27*b* remains above the air/water interface 31*b* and an inner frustoconical portion 30*b* is below the air/water interface 31*b*. The buoy 1*b* has a gas valve 41*b* to remove gas from inner chamber 19*b* to allow the inner chamber 19*b*, and especially the upper portion 27*b* thereof, to fill with water 5*b*. The water 5*b* in the upper portion 27*b* of the inner chamber 19*b* creates a downward force which stabilizes the buoy 1*b*. A fluid tight compartment 37*b* that begins at surface 15*b* and extends into the inner chamber 19*b* is accessible though the door 39*b* on the top surface 15*b*. The compartment 37*b* is optionally in other embodiments of the invention. Ballast weights are preferably positioned at the bottom end of the frustoconical portion 29*b* but may be at any location below the center of buoyancy of the buoy 1*b*.

Figure 7:
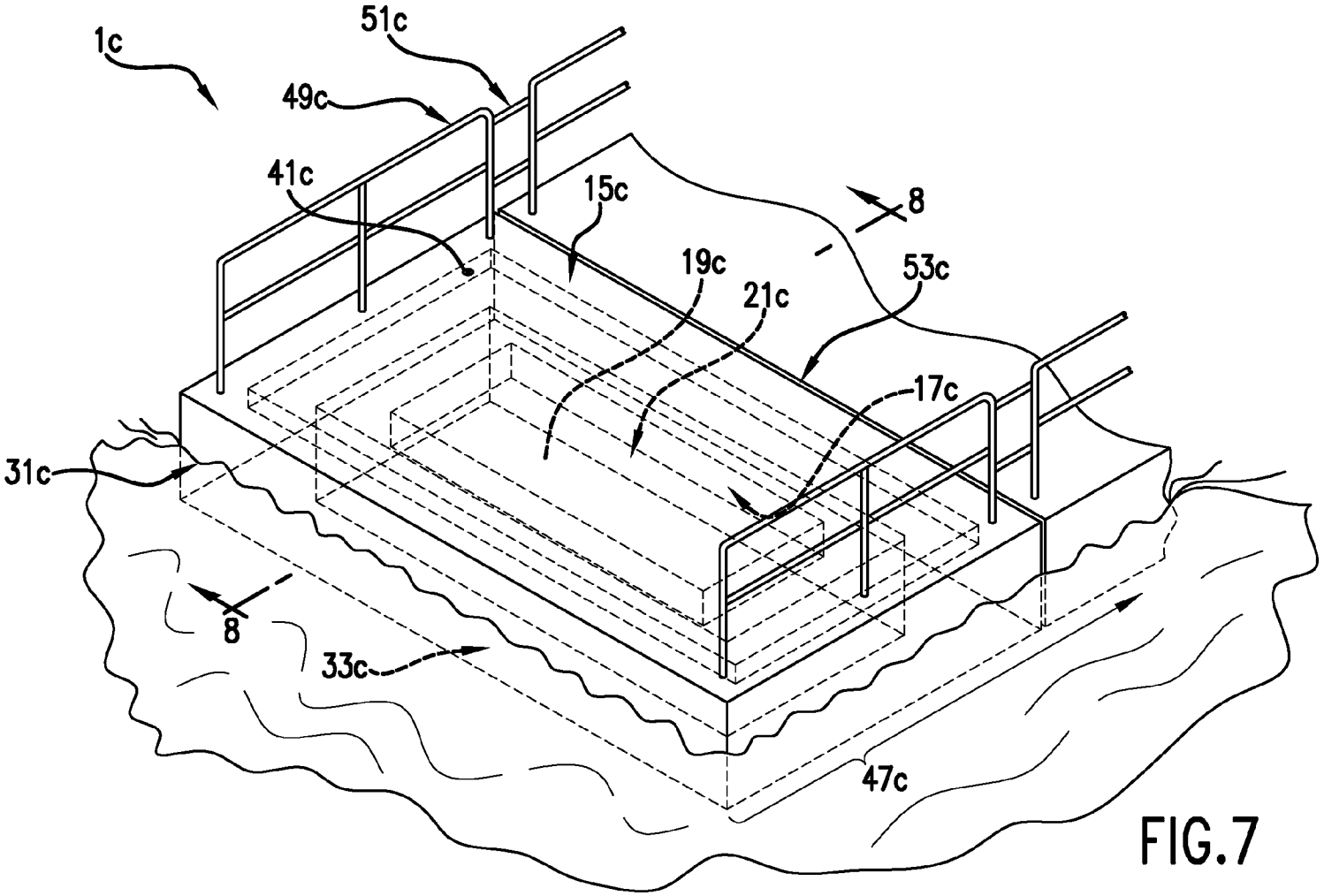
FIG. 7 is a perspective view of multiple suction stabilized docks joined together.

FIG. 7 is a perspective view of multiple suction stabilized docks 1*c* joined to form a larger dock structure 47*c*. Each dock 1*c* has an exterior surface 33*c* that includes a top surface 15*c* and sides of the dock 1*c* that extends into the water 5*c*. Each dock 1*c* has at least one gas valve 41*c* for removing gas from inner chamber 19*c*. The inner chamber 19*c* is defined by inner walls 17*c* and inner chamber top 21*c*. In the illustrated embodiment each dock 1*c* also optionally has a rail 49*c* that is attached or integrated into the dock at surface 15*c*. The rails 49*c* are optionally connected to one another at locations 51*c* when the docks 1*c* are attached to or integrated with on another at location 53*c*.

Figure 8:
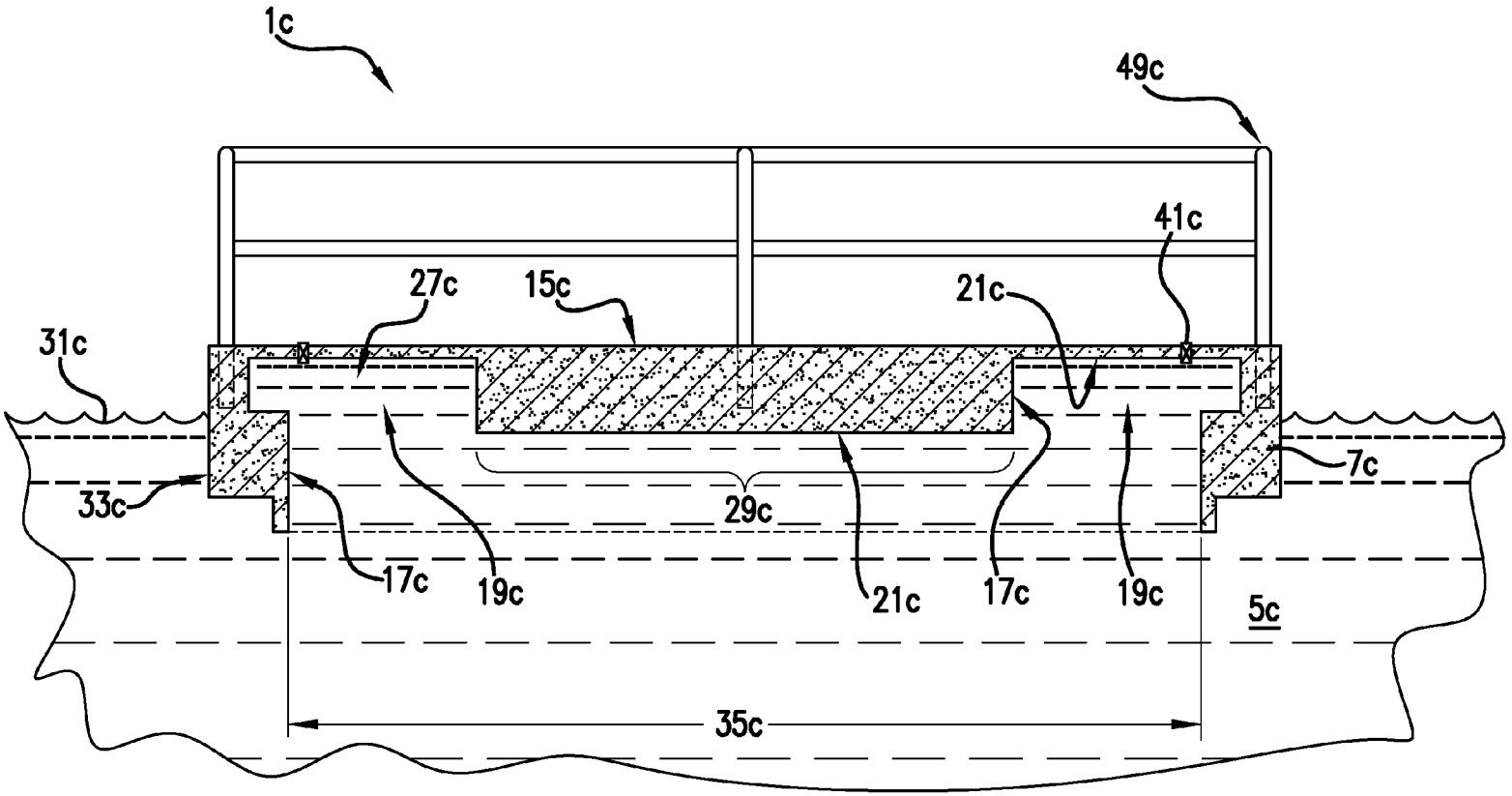
FIG. 8 is an elevational view of the suction stabilized dock of FIG. 7 taken along lines 8-8 of FIG. 7.

FIG. 8 is an elevational view of a single suction stabilized dock 1*b* having buoyant material 7*c*, for example foam, wood, contained air, or the like, sufficient to float the dock 1*c* and optional object(s) (not shown) supported thereon. The buoyant material 7*c* may optionally make up a portion or the entire the structure of the dock 1*c*. FIG. 8 is exemplary of a dock 1*c* made of buoyant material 7*c*. The dock 1*c* is an illustrated embodiment of a surface 15*c* that is optionally flat and optionally supports objects that may are attached, unattached, or integrated with the dock. The dock 1*c* optionally has a rail 49*c* that is attached or integrated into the dock surface 15*c* as well as an exterior surface 33*c* comprising the sides of the dock 1*c* which extend into the water 5*c*. The inner chamber 19*c* is defined by inner walls 17*c* and inner chamber top 21*c*. The inner chamber 19*c* has an upper portion 27*c* that is above the air/water interface 31*c* when the dock 1*c* is in water 5*c* and a lower portion 29*c* that is below the air/water interface 31*c* when the dock is in water 5*c*. In FIG. 8 the inner chamber top 21*c* is thicker in the middle of the dock 1*c* than on the sides to create two separate upper portions 27*c* or a continuous perimeter. In other embodiments the inner chamber top 21*c* may have different shapes with more or less than two upper portions 27*c* being provided. The dock 1*c* has gas valves 41*c* to remove gas from inner chamber 19*c*. This allows the inner chamber 19*c* and the upper portion(s) 27*c* of the inner chamber 19*c* to fill with water 5*c*. The bottom of the dock 1*c* has an opening 35*c* that allows the surrounding water to replace escaping air. In various embodiments the dock is used a platform or foundation for a larger structure. In various embodiments the dock is used as a foundation for a flat bottom boat.

The invention is more generally described below. These descriptions relate to the embodiments shown in the figures which are numbered as well as to embodiments not shown and therefore not numbered. The numbers are meant to reference examples of the subject matter shown in the figures, but are not exclusive to the subject matter shown in the figures. The floats 1(*a, b, c*) described herein use suction stabilization which is produced when liquid inside a partially sealed chamber 11(*a, b, c*) that is connected to an external body of liquid 5 (*a, b, c*) is drawn above the gas/liquid interface 31(*a, b, c*) between the external body of liquid and gas. The liquid in the upper portion 27(*a, b, c*) of the inner chamber 19(*a, b, c*) held at this higher elevation generates a downward force. The upward force caused by buoyancy of the float's buoyant material 7 (*a, b, c*) and the downward force generated by the elevated liquid in the upper portion 27 (*a, b, c*) of the inner chamber 19(*a, b, c*) meet at the gas/liquid interface 31(*a, b, c*) (where gas meets liquid) resulting in the two opposing forces stabilizing the float 1(*a, b, c*). The amount of downward force generated is affected by many factors, for example, by the amount of upward force the float's buoyant material 7(*a, b, c*) provides, the size and shape of the upper portion 27(*a, b, c*) of the inner chamber 19(*a, b, c*) holding the liquid above the gas/liquid interface 31(*a, b, c*), and the weight of the liquid. The distance the liquid is drawn above the liquid level of the external body of liquid 5(*a, b, c*) is optionally be referred to as head height. The various embodiments of this invention achieve suction stabilization relying on the previously discussed phenomenon.

Embodiments of the invention are composed of a floatation or buoyant portion 7(*a, b, c*) and an inner chamber 19(*a, b, c*). The inner chamber 19(*a, b, c*) is comprised of an upper portion 27(*a, b, c*) which is above the gas/liquid interface 31(*a, b, c*) created by the water line and a lower portion 29(*a, b, c*) which is below the gas/liquid interface 31(*a, b, c*) In the various embodiments of the invention the inner chamber portion 19(*a, b, c*) is of equal or greater length than the floatation portion 7(*a, b, c*). In various embodiments of the invention, the floatation portion 7(*a, b, c*) is integrated into the inner chamber 19(*a, b, c*) and comprises all or part of the float 1(*a, b, c*). The opening 35(*a, b, c*) in the inner chamber 19(*a, b, c*) may be at any point below the gas/liquid interface 31(*a, b, c*), but in preferred embodiments, is at the inner chamber's 19(*a, b, c*) lowest point. The purpose of this is to ensure that the opening 35(*a, b, c*) remains in the liquid 5(*a, b, c*) when the float 1(*a, b, c*) is in use. In all embodiments of the invention the inner chamber 19(*a, b, c*) is oriented to be partially below the gas/liquid interface 31(*a, b, c*) and partially above the gas/liquid interface 31(*a, b, c*) with the buoyant material 7(*a, b, c*) being sufficient to maintain this balance when the inner chamber 19(*a, b, c*) is filled with liquid.

The embodiments of the invention function using the application of Pascal's law which states as follow, $$\Delta P = \rho g(\Delta h)$$

where

ΔP is the hydrostatic pressure (given in Pascal's in the SI system), or the difference in pressure at two points within a fluid column, due to the weight of the fluid;

ρ is the fluid density (in kilograms per cubic meter in the SI system);

g is acceleration due to gravity (normally using the sea level acceleration due to Earth's gravity in meters per second squared);

Δh is the height of fluid above the point of measurement, or the difference in elevation between the two points within the fluid column (in meters in SI).

The application of this law means when the liquid in the inner chamber 19(*a, b, c*) is raised above the gas/liquid interface of the external body of liquid 5(*a, b, c*), the raised volume of liquid will exert a downward force equal to its weight. In the embodiments of the invention that downward force acts against any destabilization forces, for example rocking or swaying motions and thus serve to stabilize the float 1(*a, b, c*).

The embodiments of the invention function in a body of liquid 5(*a, b, c*). Once in a body of liquid, the gas from the inner chamber 19(*a, b, c*) is expelled and replaced by liquid. This can be accomplished through a variety of methods the following example. The entire float 1(*a, b, c*) is submerged under liquid 5(*a, b, c*) with the opening 35(*a, b, c*) facing upward toward the surface. Once the gas escapes from the inner chamber 19(*a, b, c*), the float 1(*a, b, c*) is rotated under the liquid so that the opening is now facing downward, away from the surface of the liquid. The float 1(*a, b, c*) is then allowed to float to the surface with this same orientation. This method is preferable in smaller floats 1*a* for example floats that require 150 lbs of force or less to submerge for example: 1 lb, 2 lbs, 3 lbs, 4 lbs, 5 lbs, 10 lbs, 15 lbs, 20 lbs, 30 lbs, 40 lbs, 50 lbs, 60 lbs, 70 lbs, 80 lbs, 90 lbs, 100 lbs, 110 lbs, 120 lbs, 130 lbs, 140 lbs, or 150 lbs.

An alternative method is to use a gas valve 41(*b, c*) to expel the gas from the chamber while the float 1(*a, b, c*) is in the liquid 5(*a, b, c*) with the opening 35(*a, b, c*) under liquid facing downward, away from the surface. This gas will be replaced by liquid from the surrounding body of liquid 5(*a, b, c*). This method may be used in floats of all sizes, but it is particularly advantageous with larger floats 1(*b, c*) as the amount of force required to sink the float 1(*b, c*) is usually substantial. In some embodiments of the invention, a ballast 43*b* is attached or integrated into the float 1(*a, b, c*) to provide extra stabilization and additionally act to self right the float 1(*a, b, c*) in the event that the float 1(*a, b, c*) capsizes.

In some embodiments of the invention the float is a moving watercraft wherein the opening to the inner chamber can be selectively opened and closed. When open, any gas in the inner chamber is expelled via an air valve and replaced by liquid. The liquid in the inner chamber acts as resistance to the movement of the watercraft and can be utilized in regular or emergency braking of the watercraft. Inner chambers placed off the center line of the watercraft can be utilized when turning the watercraft by providing resistance to the side of the watercraft that is the same as the direction of the turn. For example when turning right, the watercraft opens the inner chamber positioned on the right side of the watercraft. The water in the inner chamber provides resistance on the right side of the watercraft and on the inside of the turn which allows the watercraft to turn more sharply.

The larger the volume of liquid in the upper portion 27(*a, b, c*) (drawn above the gas/liquid interface 31(*a, b, c*)) the more downward force is created. Stabilization of the float 1(*a, b, c*) in liquid is a product of this downward force. Increased stabilization is achieved if the volume of liquid in the upper portion 27(*a, b, c*) has a larger width and depth to height ratio, but the embodiments in this invention can be any functional shapes or configurations.

In other embodiments of the invention the float 1(*a, b, c*) optionally has a flat top surface. In various other embodiments the top surface may be curved, higher or lower along the edges, or a variety of different shapes. The inner chamber 19(*a, b, c*) and buoyant material 7(*a, b, c*) may be various sizes or shapes, but the buoyant material 7(*a, b, c*) can not be so long or so buoyant as to lift any part of the opening to the inner chamber 19(*a, b, c*) out of the liquid 5(*a, b, c*).

In some embodiments the inner chamber 19(*a, b, c*) has a compartment 37*b*, container, or canister that is optionally gas/liquid tight so as to be accessed through an opening on the surface which optionally has a door 39*b*, or in other embodiments, the compartment may be accessed through an opening in the bottom, which optionally has a door. In some embodiments there is a tube 9*a* that penetrates the float 1(*a,*

*b, c*) and extends into the inner chamber 19(*a, b, c*). The tube 9*a* does not destroy or damage the seal of the gas/liquid tight inner chamber 19(*a, b, c*). In some embodiments objects are secured to the float via the tube 9*a*, for example the umbrella 3*a*.

In various embodiments of the invention the gas is air and the liquid is water 5(*a, b, c*).

In various embodiments of the invention the float 1(*a, b, c*) is a foundation or a platform for an object 3(*a, b, c*). The object 3(*a, b, c*) can be a structure that is attached or unattached to the float. The object 3(*a, b, c*) can be a living or nonliving thing. In one embodiment the float's surface 16*a* can functions as a table and may optionally contain grooves or indentions for cups, plates, and/or other items used on a table. In another embodiment the float 1*a* is a foundation for a human float. In other embodiments of the invention the float 1(*a, b, c*) can support multiple attached or integrated objects 3(*a, b, c*), unattached objects 3(*a, b, c*), or a combination of both.

In some embodiments of the invention the float is a pontoon. A pontoon is a floating structure used in many watercrafts and on some aircrafts designed to optionally take off and land on water. The pontoon is on the bottom portion of the air/watercrafts and allows them to float on the liquid. The pontoons of the claims of the invention are optionally made of buoyant material and are open or have an open portion in or along the bottom portion of the pontoon. The opening allows liquid from the surrounding body of liquid to fill the inner chamber while gas is expelled through a valve on the pontoon float. The liquid inside the pontoon is held above the liquid of the surrounding body of liquid and thus creates a downward force which stabilizes the float.

Using water instead of conventional ballast also has the advantage of utilizing the adhesion and cohesion properties of water to further stabilize the float.

EXAMPLE

An experiment was conducted to calculate the static force created by a 30" diameter float. The float was put into water and the air within was purged. The 30" diameter circular Suction Stabilized Device resulted in 2⅛" of fluid (water) being raised above the interface (surface of water). This volume was calibrated to contain 3.25 gallons of water. Water weighing approx. 8.34540 pounds per gallon equals a static force created of 27.122 pounds.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The drawings in the application show embodiments wherein the chamber depicted has been at least substantially filled with water.

What is claimed is:

1. A float suitable for supporting objects on water comprising:

at least one floatation device comprising a buoyant material of a size sufficient to support at least 10 pounds above a waterline, wherein said floatation device is unitary with or secured to an inner chamber wherein the inner chamber comprises a chamber top and a inner wall secured or unitary with the chamber top, wherein the inner chamber is open only on a side opposite to the chamber top, and wherein the inner chamber is adapted to be substantially filled with a volume of the water thereby creating suction which is sufficient to raise the water in the inner chamber above a waterline, and wherein the water raised above the waterline remains in connection with the water of the waterline, wherein the suction stabilized float has only one inner chamber, and wherein the float additionally comprises an umbrella wherein the umbrella is attached to the chamber top via a tube that penetrates the chamber top but maintains a gas and liquid tight seal with the chamber top.

2. The float of claim 1 wherein the float additionally comprises an air valve adapted for expelling air from the inner chamber.

3. The float of claim 1 wherein the volume of water raised above the waterline weights at least 25% of the total weight of said float.

4. The float of claim 1 which additionally comprises a pump capable of removing gas or aiding in the removal of gas from said inner chamber.

5. The float of claim 1 wherein the float can be submerged with a minimum of 150 lbs of force.

* * * * *